United States Patent [19]

Becker et al.

[11] 4,046,060

[45] Sept. 6, 1977

[54] HYDRAULIC CONTROL SYSTEMS FOR USE WITH MINING APPARATUS

[75] Inventors: Kunibert Becker, Werl; Walter Weirich, Dortmund, both of Germany

[73] Assignee: Gewerkschaft Eisenhutte Westfalia, Westfalia, Germany

[21] Appl. No.: 601,643

[22] Filed: Aug. 4, 1975

[30] Foreign Application Priority Data

Aug. 22, 1974 Germany ..... 2440211

[51] Int. Cl.[2] ..... F15B 11/16

[52] U.S. Cl. ..... 91/414; 91/166; 91/415; 91/446; 91/463

[58] Field of Search ..... 91/165, 166, 170 MP, 91/414, 415, 446, 463, 464; 60/486

[56] References Cited

U.S. PATENT DOCUMENTS

| | | | |
|---|---|---|---|
| 3,115,754 | 12/1963 | Joseph | 91/170 MP |
| 3,227,049 | 1/1966 | Favrot | 91/166 |
| 3,643,547 | 2/1972 | Kraakman | 91/165 |
| 3,895,490 | 7/1975 | Pachins | 91/448 |
| 3,895,779 | 7/1975 | Cassez et al. | 91/44 |

FOREIGN PATENT DOCUMENTS

| | | | |
|---|---|---|---|
| 1,079,860 | 8/1967 | United Kingdom | 91/170 MP |

*Primary Examiner*—Martin P. Schwadron
*Assistant Examiner*—Abraham Hershkovitz
*Attorney, Agent, or Firm*—Thompson, Birch, Gauthier & Samuels

[57] ABSTRACT

A hydraulic control system for use with double-acting shifting rams in a mine working.

The system has a pump for supplying pressure fluid and main and return feed lines or conduits connected to the pump and laid along the working. An adjustable pressure-regulating device or devices serves to provide fluid at variable pressure in a further feed line or conduit.

Each ram has its working chambers connected to a control device which is in turn connected to the main and further feed lines or conduits and to the return line or conduit. The devices can each be set to various positions to operate the rams. In order to extend one of the rams its associated device is set to connect the working chamber used for extension (having the larger piston working surface area) to the further feed line or conduit, and to connect the other working chamber used for retraction (having the smaller piston working surface area) to the to the main feed line or conduit. With the aid of the pressure-regulating device or devices the force of the ram can then be controlled.

5 Claims, 2 Drawing Figures

HYDRAULIC CONTROL SYSTEMS FOR USE WITH MINING APPARATUS

BACKGROUND TO THE INVENTION

The present invention relates to a hydraulic control system for use in mineral mining installations and to mineral mining installations employing such a system.

In general, the control system is intended for controlling the operation of a series of double-acting shifting rams.

In various forms of mining apparatus it is known to use horizontal shifting rams. For example, such rams are used to horizontally advance a longwall conveyor in relation to roof support chocks or frames. Hitherto control systems have been used to supply hydraulic pressure fluid to the rams so that when a ram is to be extended one of its working chambers is supplied with pressure fluid and the other of its working chambers is connected to a fluid return path. Conversely, when the ram is to be retracted the situation is reversed with the other working chamber now being supplied with fluid.

It is also usual for the piston surface area exposed to the fluid in the first chamber, supplied to extend the ram, to be greater than that exposed to the fluid in the other chamber, supplied to retract the ram. The ram may have its cylinder secured to a vertically extending roof support chock or frame and its piston rod secured to the conveyor, for example, so that with the chocks or frame set or braced vertically between the roof and floor the ram can be horizontally extended to advance the conveyor and with the chock or frame released the ram can be retracted to draw up the frame towards the conveyor. During the mineral winning process it is desirable for the ram to urge the conveyor and hence the winning machine against the mineral face or seam but hitherto it has not been possible to effect any suitable controlled adjustment of the force applied by the rams to cope with the changing conditions. Although it is known from German Pat. No. 1,058,003 to supply compressed air to the other working chamber of a ram, used for retraction, while the first working chamber, used for extension is supplied with pressure fluid at a greater pressure, this counter-force is constant and serves merely to resiliently damp the piston of the ram so there is no control of the force of the ram.

A general object of this invention is to provide an improved form of control system for use with mining apparatus of the aforementioned kind.

SUMMARY OF THE INVENTION

According to the present invention there is provided a hydraulic control system for use with a series of double-acting hydraulic rams in a mineral mining installation, wherein each ram has a first working chamber which can be charged with pressure fluid to extend the ram and a second working chamber which can be charged with pressure fluid to retract the ram, the piston surface area exposed to the fluid in the first chamber being greater than the piston surface area exposed to the fluid in the second chamber; said control system comprising a main pressure fluid feed line or conduit, at least one further pressure fluid feed line or conduit, a pressure fluid return line or conduit, means for varying the pressure of the fluid in said at least one further line or conduit and control devices each associated with at least one of the rams and serving to selectively connect the working chambers of the ram to the pressure fluid feed and return lines or conduits to effect operation of the ram, wherein each device can be set to connect the main feed line or conduit to the second chamber of the associated ram and to connect the further feed line or conduit to the first chamber of the associated ram whereby with the aid of said pressure-varying means the force produced by the ram during extension can be altered.

The invention also provides the combination of a series of double-acting hydraulic rams in a mineral mining installation and a control system for operating the rams, each ram having a first working chamber which can be charged with pressure fluid to extend the ram and a second working chamber which can be charged with pressure fluid to retract the ram, the piston surface area exposed to the fluid in the first chamber being greater than the piston surface area exposed to the fluid in the second chamber; and the control system comprising a main pressure fluid feed line or conduit, at least one further pressure fluid feed line or conduit, a pressure fluid return line or conduit, means for varying the pressure of the fluid in said at least one further line or conduit and control devices each associated with at least one of the rams and serving to selectively connect the working chambers of the ram to the pressure fluid feed and return lines or conduits to effect operation of the ram, wherein each device can be set to connect the main feed line or conduit to the second chamber of the associated ram and to connect the further feed line or conduit to the first chamber of the associated ram whereby with the aid of said pressure-varying means the force produced by the ram during extension can be altered.

In another aspect the invention provides a mineral mining installation comprising a longwall conveyor arranged in a mine working and supporting a mineral winning machine, a plurality of units, such as roof support chocks or frames, each capable of being braced between the roof and floor of the working or released, shifting rams supported by the units and serving to effect advancement of the conveyor and the units, each ram having a first working chamber which can be charged with pressure fluid to extend the ram and advance the conveyor relative to the associated unit and a second working chamber which can be charged with pressure fluid to retract the ram and shift the unit up to the conveyor, the piston surface area exposed to the fluid in the first chamber being greater than that exposed to the fluid in the second chamber and a control system for controlling the operation of the rams, said control system having a main pressure fluid feed line or conduit, at least one further pressure fluid feed line or conduit, a pressure fluid return line or conduit, means for varying the pressure of the fluid in said at least one further line or conduit and control devices each associated with at least one of the rams and serving to selectively connect the working chamber of the ram to the pressure fluid feed and return lines or conduits to effect operation of the ram, wherein each device can be set to connect the main feed line or conduit to the second chamber of the associated ram and to connect the further feed line or conduit to the first chamber of the associated ram whereby with the aid of said pressure-varying means the force produced by the ram during extension can be altered.

Normally the pressure prevailing in the further feed line or conduit is somewhat less than the pressure in the main line or conduit which is usually constant but the piston surface area differential ensures that the ram can extend when desired. The pressure-varying means enables adjustment of the force produced by any one of the rams to be controlled however in a simple yet reliable manner to suit the prevailing conditions.

In accordance with a further preferred feature of the invention the pressure-varying means can be in the form of one pressure regulating adjustable valve device or a number of such devices.

The main feed line or conduit and the further feed line or conduit may both be fed from a common source or from separate sources. In the former case it is preferred that the pressure-varying means is in the form of a single common pressure regulating valve device connected between the further feed line or conduit and the main feed line or conduit. This main feed line or conduit can then be led back with the return line to a common pump.

It is also possible to have several further feed lines or conduits each connected to a respective one of the control devices and through a pressure regulating valve device to the main feed line or conduit, the pressure regulating valve devices constituting said pressure-varying means. The pressure regulating devices can then be conveniently combined with the control devices to form structural units mounted for example on the roof support chocks or frames serving as supports or abutments for the rams.

In an installation constructed in accordance with the invention, the individual rams can thus be extended with an adjustable force by the supply of pressure fluid at adjustable pressure, fed to their first working chamber having the larger piston surfaces. This enables the overall force, applied to the winning machine by the conveyor, to be varied to suit the conditions and particularly the hardness of the mineral. When the rams are to be retracted, however, to draw up the chocks or frames or the like the first chambers can be exhausted to the return line or conduit and the second chambers supplied with pressure fluid from the main feed line or conduit.

The invention may be understood more readily, and various other features of the invention may become more apparent, from consideration of the following description.

BRIEF DESCRIPTION OF DRAWING

An embodiment of the invention will now be described, by way of example only, with reference to the accompanying drawing, wherein.

DESCRIPTION OF PREFERRED EMBODIMENTS

Figure 1:
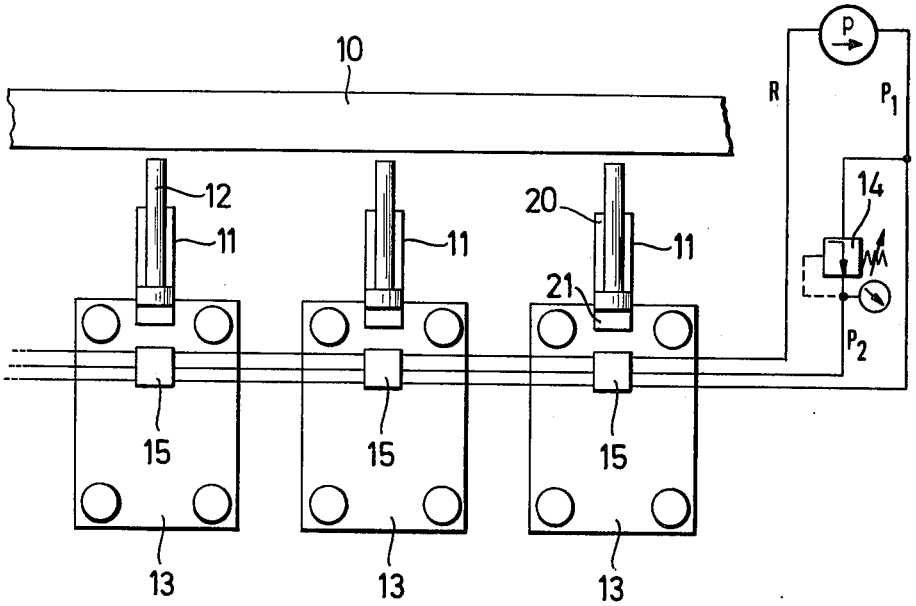
FIG. 1 is a schematic representation of part of a mineral mining installation employing a hydraulic control system made in accordance with the invention.

As shown in FIG. 1, a mineral mining installation has a scraper-chain conveyor 10 arranged in a mine working in known manner alongside a longwall mineral or coal face (not shown). A mineral winning machine, such as a plough (not shown), is mounted or supported for movement back and forth along the conveyor to detach mineral which is then transported by the conveyor 10 in known manner. The conveyor 10 is itself composed of a series of channel sections joined end-to-end with a certain degree of free mobility or articulation between the individual sections. A scraper-chain assembly is circulated along the channel sections to effect the transport of the material delivered thereon. The conveyor 10 is shifted from time to time towards the face as the winning work progresses. Usually the conveyor is moved up over successive sections in the so-called "snaking" movement. In order to advance the conveyor 10 use is made of a number of double-acting hydraulic rams 11 disposed along the working and connected with a control system as will be described. Each ram 11 has its piston rod 12 connected to the conveyor 10 and its cylinder anchored to or supported by a unit 13 which may be any form of roof support frame or chock of any type or a similar component such as a single hydraulic prop. The important criteria for the unit 13 is that apart from performing any other functions, which do not concern the present invention, they are each capable of being rigidly braced, preferably between the roof and the floor of the working, to form an abutment for the associated ram 11 or released, i.e. to a non-braced condition, for shifting purposes. It follows that each ram 11 can be extended individually to urge the associated part of the conveyor 10 forwards when the unit 13 associated therewith is braced. The ram 11 can also be used to firmly hold the conveyor 10 in position while the mineral winning work takes place. When the ram 11 in question has been fully extended the associated unit 13 can be released and the ram 11 retracted to draw up the unit 13 towards the conveyor 10 ready for the next sequence. Where the units 13 are in the form of the so-called self-advancing or walking frames the unit 13 can be shifted without the use of the ram 11 or by using the ram 11 as a supplementary aid. In any event during the mining operation the rams 11 are alternately vertically retracted and extended to horizontally advance the conveyor 10 in stages.

Although each ram 11 is allocated to a single unit 13 in FIG. 1, it is quite feasible to have rams 11 allocated to only some units or to have one ram supported by two adjacent units or to adopt other obvious modifications.

The hydraulic control system for controlling the ram 11 will now be described.

Still referring to FIG. 1, the system has a main hydraulic pressure fluid feed line or conduit P1 and a main hydraulic pressure fluid return line or conduit R. These lines or conduits P1, R are laid along the longwall working and may connect with various other appliances (not shown). The line or conduit P1 is connected to a source — usually the outlet of a pump (not shown) whereas the line or conduit R is connected to the inlet of the pump or to a reservoir or storage vessel feeding this inlet. As shown, a further supplementary hydraulic pressure fluid feed line or conduit P2 is also laid along the working. This line or conduit P2 may be connected to another pressure fluid source through a pressure regulating or adjustment valve device 14. In the illustrated embodiment, however the device 14 is fed directly by the main line or conduit P1 so that the lines or conduits P1, P2 are fed by a common source. The pressure prevailing in the line or conduit P2 can be set and regulated by the device 14 to some pre-determined adjustable value which in the illustrated embodiment is less than the pressure prevailing in the main line or conduit P1. The device 14 can be directly manually operated or operated automatically or remotely.

Each ram 11 is operably associated with a control device 15 which can be conveniently mounted on the unit 13 with which the ram 11 is associated. As with the device 14, each device 15 can be directly manually operated or operated automatically or remotely to connect the working chambers of the ram 11 to the lines or conduits P1, P2, R as will now be described.

Figure 2:
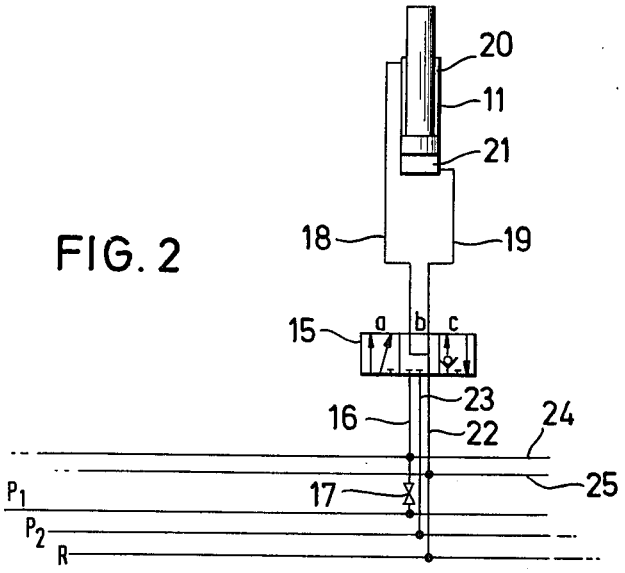
FIG. 2 is a schematic representation of one of the shifting rams of the system shown in FIG. 1 together with its associated control device.

As shown in FIG. 2, each device 15 has a first set of three ports which may be considered as inputs. Thus, a first input is connected through a line or conduit 16 and a check valve 17 to the main line or conduit P1; a second input is connected through a line or conduit 23 to the line or conduit P2 and a third input is connected through a line or conduit 22 to the return line or conduit R. The first and third inputs are also connected directly to further lines or conduits 24, 25 respectively. These lines or conduits 24, 25 which thus connect with the lines or conduits P1 and R, respectively, serve to convey pressure fluid to and from the units 13. Each device 15 also has another set of two further ports which may be considered as outputs, namely a first output connected through a line or conduit 18 to a working chamber 20 of the associated ram 11 and a second output connected through a line or conduit 19 to a working chamber 21 of the associated ram 11. As can be appreciated admission of fluid to the chamber 20 alone would cause retraction of the ram 11 and admission of fluid to the chamber 21 alone would cause extension of the ram 11. In known manner, the full working surface of the piston exposed to the fluid in the chamber 21 is somewhat greater in area than the annular working surface of the piston exposed to the fluid in the chamber 20. Thus a greater force can be developed by admitting fluid at a given pressure into the chamber 21 than into the chamber 20.

The device 15 can be set, manually or otherwise, into one of three operating conditions or states as represented in FIG. 2 by the references *a, b* and *c.* In state *a,* the first input is connected to the first output, the second input is connected to the second output and the third input is blocked. In state *b,* the third input is connected to both the first and second outputs and the first and second inputs are blocked. In state *c,* the first input is connected to the first output via an internal non-return valve, the third input is connected to the second output and the second input is blocked.

The operation of the device 15 and of the system is as follows:

With the device 15 set to state *b,* as represented in FIG. 2, the chambers 20, 21 of the ram 11 are both connected to the return line or conduit R so that the ram 11 is essentially disabled and non-operative. When the unit 13 is braced, the device 15 can be set to state *a,* to effect extension of the ram 11 and advancement of the conveyor 10 portion connected therewith or to effect clamping of the conveyor 10 in such a manner as to exert a force on the winning machine. In state *a,* the device 15, enables pressure fluid from the main line or conduit P1, to be supplied to the chamber 20 and pressure fluid from the line or conduit P2 to be supplied to the chamber 21. It will be recalled that the pressure in the line or conduit P2 and hence in the chamber 21 can be varied by the device 14 and would be somewhat less than the constant pressure in the line or conduit P1 and hence in the chamber 20. Where the lines or conduits P1, P2 have separate sources the pressure in the line or conduit P2 need not necessarily be always less than that in the line or conduit P1. In any event the greater working area of the piston in the chamber 21 is sufficient to ensure that the force differential on the piston can be resolved in favour of the chamber 21 to effect extension of the ram 11 despite the counter-force from the chamber 20. By means of the device 14 the force differential on the piston can be varied to thereby alter the thrust produced by the ram 11 or balanced out to zero so as to lock the ram 11 and hence clamp the conveyor 10.

When it is desired to shift the unit 13, the latter is released from its braced condition and the device 15 is set to state *c.* In this case fluid in the chamber 21 is exhausted to the return line or conduit R whereas the chamber 20 is exposed to pressure fluid from the line or conduit P1 thus causing the ram 11 to retract. Since the unit 13 is free to move with the cylinder of the ram 11 the unit 13 will be shifted up to the conveyor 10.

The same modes of operation will apply to all the devices 15 and their rams 11 and the operation of each consumer appliance composed of a ram 11 and its device 15 can be synchronized with that of another appliance 11, 15 if desired so that, for example, these appliances 11, 15 operate in succession through similar working cycles.

Instead of utilizing a single common adjustment device 14 for all the devices 15 it may be preferred to provide each device 15 with its own device 14. In this case the devices 14, 15 can be combined into structural units each mounted on one of the units 13, for example, to provide a greater flexibility to the system. The pressure fluid line or conduit P2 would in this case not be common to all the appliances 11, 15 and the device 15 of each appliance 11, 15 would have its own feed line as conduit P2 in which the pressure can be varied, e.g. independently of the other lines or conduits P2 for the other appliances 11, 15.

In a further modification it is possible to combine these alternative arrangements so that for example the adjustable pressure provided to the rams 11 is reduced in successive stages, say by using a common device 14, followed by individual devices 14 for each appliance 11, 15.

We claim:

1. For use with mineral mining equipment having a series of double-acting hydraulic rams for shifting a conveyor, each ram having a first working chamber which is charged with pressure fluid to extend the ram and a second chamber which is charged with pressure fluid to retract the ram, an improved hydraulic control system for operating the rams, said system comprising:

a. at least one pressurized source of hydraulic fluid;

b. main pressure fluid feed conduit means connected to said at least one pressurized source;

c. pressure fluid return conduit means connected to said at least one pressurized source;

d. further pressure fluid feed conduit means connected to said at least one pressurized source;

e. regulating means for varying the pressure of the fluid in said further conduit means; and f. a plurality of control devices each associated with at least one of the rams and connected to the working chambers of the rams on the one hand, and connected to said main conduit means, and to said further conduit means, and to said return conduit means on the other hand, each said control device selectively connecting the working chambers with various combinations of said conduit means, each said control device having three intake ports and two outlet ports, said first intake port connected to said main conduit means, said second intake port connected to said further conduit means, and said third intake port connected to said return conduit means; said first outlet port connected to the second working chamber of the associated ram, and said second outlet port connected to the first working chamber of the associated ram, each said control device adjusting the three operative states comprising: a first state wherein said first intake port is connected to said first outlet port, said second intake port is connected to second outlet port, and said third intake port is blocked; a second state wherein said third intake port is connected to both said first and said second outlet ports, and said first and said second intake ports are blocked; and a third state wherein said first intake port is connected to said first outlet port, said third intake port is connected to said second outlet port, and said second intake port is blocked; and wherein adjusting said control device to the first state causes the ram to extend, and adjusting said control device to the third state causes the ram to retract.

2. A system according to claim 1, wherein said at least one source includes a common source supplying fluid to said main conduit means and said further conduit means.

3. A system according to claim 1, wherein said source is a pump, and said pressure regulating means is a pressure regulating valve device mounted in said further conduit means.

4. A system according to claim 1, wherein said further conduit means includes a plurality of branch conduits, each branch being connected to a respective one of said control devices, and each branch containing a pressure regulating valve device, said valve devices collectively constituting said pressure regulating means.

5. A system according to claim 1, wherein said pressure regulating means maintains the fluid pressure in said further conduit means below that which prevails in said main conduit means, the latter pressure being constant.

* * * * *